US005927559A

United States Patent [19]

Bommer et al.

[11] Patent Number: 5,927,559

[45] Date of Patent: Jul. 27, 1999

[54] VENTED DISPENSER FOR MEDIA WITH FILTER

[75] Inventors: Rene Bommer, Radolfzell; Michael Stifel, Allensbach-Freudental, both of Germany

[73] Assignee: Ing. Erich Pfeiffer GmbH, Radolfzell, Germany

[21] Appl. No.: 08/816,581

[22] Filed: Mar. 13, 1997

[30] Foreign Application Priority Data

Mar. 16, 1996 [DE] Germany ..... 196 10 457

[51] Int. Cl.[6] ..... B67D 5/58

[52] U.S. Cl. ..... 222/189.09; 222/189.11; 222/321.2; 222/321.9

[58] Field of Search ..... 222/189.09, 189.11, 222/321.7, 321.9, 321.2, 385

[56] References Cited

U.S. PATENT DOCUMENTS

| | | | |
|---|---|---|---|
| 3,149,758 | 9/1964 | Bush et al. | 222/189.09 |
| 4,694,976 | 9/1987 | Schuetz | 222/189.11 |
| 4,853,013 | 8/1989 | Rio et al. . | |
| 5,074,440 | 12/1991 | Clements et al. . | |
| 5,238,153 | 8/1993 | Castillo et al. . | |
| 5,727,715 | 3/1998 | McKenna et al. | 222/189.09 |

FOREIGN PATENT DOCUMENTS

| | | |
|---|---|---|
| 0 363 172 A3 | 4/1990 | European Pat. Off. . |
| 0 487 412 A1 | 5/1992 | European Pat. Off. . |
| 3810779 A1 | 10/1988 | Germany . |
| 89 04 692 U | 7/1989 | Germany . |
| 4403755 A1 | 11/1994 | Germany . |
| 4321927 A1 | 1/1995 | Germany . |
| 4412222 A1 | 10/1995 | Germany . |
| 1320639 | 6/1973 | United Kingdom . |
| WO 94/11115 | 5/1994 | WIPO . |

OTHER PUBLICATIONS

European search report dated Jun. 18, 1997 in European Appl. No. 97103823.7.

German search report dated Nov. 13, 1996 in German Appl. No. 196 10 457.2.

*Primary Examiner*—Kevin P. Shaver

*Attorney, Agent, or Firm*—Quarles & Brady LLP

[57] ABSTRACT

A pump (2) is secured to a reservoir vessel (3) with a seal interposed. The seal contains a filter unit (20) to enable filtered outside air to be replenished in the reservoir chamber (35) in the course of it being emptied. As a result of this the air does not need to flow through the interior of the pump (2). In addition, the filter (21) does not need to be selected according to requirements until pump and reservoir are assembled. Furthermore, assembly is simplified and no separate mount for the filter (21) is needed.

26 Claims, 1 Drawing Sheet

VENTED DISPENSER FOR MEDIA WITH FILTER

TECHNICAL FIELD OF THE INVENTION

The invention relates to a dispenser or discharge device suitable for storing or discharging liquid, pasty, powdery and/or gaseous media. Such media may be pharmaceutical, cosmetic or technical preparations which in application are released from the discharge device at a medium orifice.

DESCRIPTION OF THE BACKGROUND ART

For such dispensers it is expedient when a chamber can be replenished with an inert filler medium during operation, for example, to compensate for a vacuum. One such filler medium, for instance, outside air is, contrary to the non-compressible preparation, mostly compressible. After the chamber has been partly or totally emptied, this filling medium fills the resulting vacant space e.g. by it being drawn by the vacuum into the chamber until pressure has been compensated to equal that of the outside air. Such means are thus particularly suitable for a reservoir chamber which contains a plurality of dispensed amounts of preparation, each one of which is output from the medium outlet on every discharge action by a dispensing unit which may contain a dosing chamber separate from the reservoir chamber. The former is then refilled from the reservoir chamber following each discharge action and then closed off with respect to the reservoir chamber on the subsequent discharge action. As a result, the medium does not flow back into the reservoir chamber, it instead flows to the medium outlet. For this purpose the medium chamber may be pressurized, for example, by its volume being diminished and then re-enlarged for drawing in an amount of the medium to be subsequently dispensed from the reservoir chamber. In the rest or initial position the path of the medium in passing through the dispensing unit from an inlet up to the medium outlet including the medium chamber, is advantageously closed off pressure-tight, so that no air is able to enter into the reservoir chamber or the medium chamber from without.

To prevent the ingress of particles and/or germs when venting the chamber a filter is expediently provided in the venting path. In addition, the reservoir chamber is substantially closed off tight with respect to the outer atmosphere, namely via a sealing seat between the dispensing unit and the reservoir unit. For securing the dispensing unit to the reservoir unit in a rigid position, the sealing faces of this sealing seat are pressed against each other and locked in place. For this purpose an elastically compressible separate sealing unit is disposed between the dimensionally rigid sealing faces of the units. The venting path is then not routed through the internal or housing spaces of the dispensing unit, but is instead provided as a parallel path totally separated from the paths of the medium and also from venting paths which serve to vent such housing spaces of the dispensing unit not subjected to or passed by the medium. Accordingly, the filler medium can only gain access to the chamber to be vented by flowing it through the filter.

The volumetrically variable chamber may also be formed by the reservoir chamber, for example, by a soft squeeze bottle. The neck thereof holds the dispenser unit which comprises the medium inlet permanently communicating with the bottle. As a result, the dispensing unit remains firmly mounted on the reservoir chamber during discharge.

OBJECT OF THE INVENTION

An object of the invention is to provide a dispenser in which the disadvantages of known configurations or configurations of the kind described are avoided and which particularly ensures a simple configuration or assembly e.g. so that a highly compact arrangement of the filter is possible.

SUMMARY OF THE INVENTION

In accordance with the invention the filter unit is supported directly by the reservoir unit so that it is not positively held until or following assembly of reservoir unit and dispensing unit, particularly by being clamped between holding faces of the two units. In this arrangement the filter unit may be optionally preassembled either with the dispensing unit forming the discharge device or with the reservoir unit. In either case, the is filter unit is centered as regards its axial position while being fixed, however, in only one axial direction by axial contact with the holding face. On assembly the filter unit then also comes into contact with the second holding face and is centered with respect to the latter. Accordingly, up until assembly the choice can be made as to whether a filter is to be incorporated or not, and if so, which kind of filter is to be used.

The filter may also be employed directly for tightly closing the neck or reservoir opening so that only the venting path remains open for flow. More particularly, the filter may be provided as the sole seal for sealing the assembly gap between the dispensing unit and the reservoir unit, thus doing away with the need for any further seal. The filter is located totally on the outer side of the reservoir unit or the dispensing unit, the latter protruding into the neck and chamber of the reservoir so that this outer side bounds the reservoir space up to the filter. The filter could be located within the neck of the reservoir which is expediently integrally formed with the vessel. As a result, the filter can be fixed with tension between parallel end faces and, where appropriate, between concentric circumferential faces of the reservoir unit and the dispensing unit.

Irrespective of the configuration described, a filter unit may be composed of several components, for example sheet layers, one of which is configured as the filter and one as the seal, the latter being substantially thinner than the filter. The seal is impermeable for medium over the entire extent of its areal extension while, however, liberating an outlet of the filter in the region of its rim so that air is able to flow into the reservoir chamber from this outlet.

Irrespective of the configurations described, it is expedient to provide a disk-shaped, planar filter through which the flow passes over the majority of its extent between remote edge faces and parallel to the plane of the filter. In the inlet of this filter material the air is able to enter parallel and/or transverse to the plane of the filter. Correspondingly, the air is also able to emerge from the filter material, in this case preferably only at one axial exit, with the full surface of the associated edge face being covered by the associated unit tightly or with pressure.

The dispensing unit and the reservoir unit are mutually tensioned axially and/or radially following assembly with a fastener, the latter also tensioning the filter unit. This ring or cap-shaped tensioning member clasps the units by its outer circumferences and may be a screw cap, a crimp ring or the like.

Irrespective of the configurations described, the filter may be located at least partly without contact in an annular filter chamber located outside of the reservoir unit and/or of the dispensing unit but particularly bounded by the inner side of the fastener. A vent opening may pass through the fastener to provide an air inlet into the filter chamber.

Irrespective of the configurations described, it is expedient to provide in the venting path a pressure-responsive closure, such as a valve, the closure seat or valve member of which is formed directly by the filter or in the closed position is supported on the filter. The valve and the filter can thus form a preassembled unit. Preferably the second closing seat is formed by the seal. If the associated valve part can bend or deflect for opening and closing then it forms a valve flap. The filter material, the seal and the valve part may be connected to each other as a sandwich structure by bonding or simply loosely sandwiched so that they are not forced against each other until pressure is applied.

Advantageously, the filter constitutes a diaphragm filter, a germ filter or a sintered filter. The filter may be semipermeable, passing only gas and no liquid or consist over its full extent of a homogenous filter material simultaneously acting as a seal.

Due to the configuration of the invention, preservatives which may be mixed with medium in the reservoir can be totally eliminated. Furthermore, air is not drawn into the chamber and vented through all flow paths of the dispensing unit, but instead air flows from the filter unit only along the outermost exposed outer surface of the dispensing unit and along the inner circumference of the reservoir unit into the reservoir chamber. If the closing seat of the valve is formed by the outlet of the filter material then the latter is also unable to come into contact with the preparation.

BRIEF DESCRIPTION OF THE DRAWINGS

Example embodiments of the invention are explained in more detail in the following description and illustrated in the drawings in which.

DETAILED DESCRIPTION

Figures 1, 2:
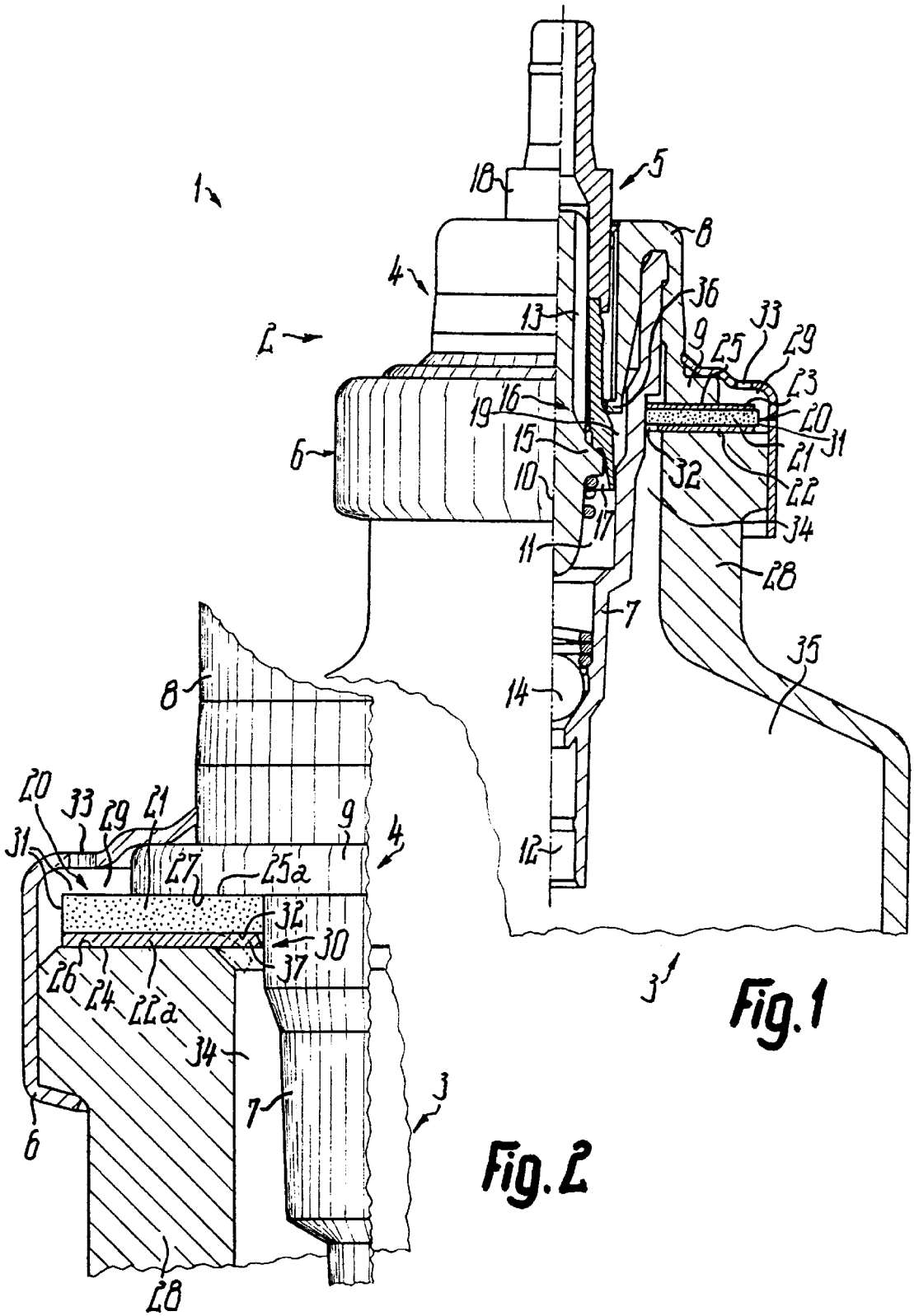
FIG. 1 is a partially cross-sectional view of a discharge device in accordance with the invention.
FIG. 2 is a section of FIG. 1 in a modified configuration shown significantly magnified.

The dispenser 1 in accordance with FIGS. 1 and 2 is depicted in the initial or rest position and is initially produced as a ready-to-function dispensing unit 2 which can then be firmly connected to a reservoir unit 3. A single-or multi-part base unit 4 of the unit 2 is connected firmly to the unit 3 so that it protrudes by the majority of its length into the interior thereof. Shiftably disposed in the unit 4 is an actuator unit 5 protruding out of the units 3, 4 and through which the medium flows for output to the exterior. The securing of the unit 4 is done by means of a fastener 6, in this case a crimp ring, which is plastically deformed on assembly of the units 2, 4 and 3. The member 6 then positively clasps by its end sections the remote end faces of the units 3, 4. Such a backing grip is also achieved in the case of a screw cap via the interacting flanks of the thread.

The unit 4 forms a hollow housing stepped throughout its length. The shell 7 or housing wall protrudes by its inner end into the reservoir. The outer end of the shell 7 is covered by a closure, for example a cover 8. This cover may be joined pressure-tight via a snap connector to the outer rim of the shell 7. Protruding from the outer side of the shell 7 is an annular shoulder or annular flange 9 which may be configured integrally with the shell 7 or cover 8 and serves to axially support the unit 4 on an outermost end face of the unit 3. The unit 3 is in this case formed merely by a bottle. This bottle may be configured integral throughout, its walls being sealingly closed in every operating condition except for a reservoir opening. During assembly, the units 2, 3 are inserted into the reservoir opening. The fastener 6 clasps the flange 9 and a correspondingly protruding flange at the outer circumference of the unit 3. The member 6 orients the center axis 10 of the units 2 to 5 in line with the center axis of the reservoir opening with zero radial clearance. As a result of this, an annular passage remains free between the outer circumference of the shell 7 and the inner circumference of the reservoir opening, this passage permanently connecting the reservoir opening to the reservoir. The fastener 6 is illustrated on the right in FIG. 1 prior to being shaped and on the left in FIG. 1 as well as in FIG. 2 after being formed. The inner circumference of the shell 7 bounds a media chamber 11 which in this case is a pressure or pump chamber. The dispensing unit 2 is a thrust piston pump. The media chamber 11 communicates via an inlet duct 12 with the reservoir chamber 35 and via an outlet duct 12 with the reservoir chamber 35 and via an outlet duct 13 with the media outlet. Between each duct 12, 13 and the media chamber 11 a valve is provided and located totally within the shell 7. The valves open in response to the actuating travel of the unit 5 and/or in response to a change in pressure. The inlet valve 14 opens when a vacuum exists in the media chamber 11 and the outlet valve 15 opens when overpressure exists in the media chamber 11. In the case of overpressure in the media chamber 11, the valve 14 closes, and when a vacuum exists in the media chamber 11, the valve 15 closes. As a result, the media paths 11, 12, 13 which connect the reservoir chamber 35 to the media outlet are always closed pressure-tight by at least one valve. Like the valve chamber of the valve 14, the inlet 12 is bounded by the shell 7. The valve 15 is totally arranged on the unit 5, through which the duct 13 passes.

The unit 5 contains a piston unit 16, the piston including a lip slidingly and sealingly guided on the inner circumference of the shell 7, bounding media chamber 11 at its outer end and made in one part with one of the valve parts of the valve 15. The shell or ring-shaped piston 17 is arranged on a plunger rod 18 traversing the outer end of the housing 7, 8. An actuating and discharge head (not shown) may be mounted on the outer, protruding end of a member 18. This actuating and discharge head comprises a medium orifice, e.g. an atomizer nozzle. This head forms the handle with which the unit 5, 16 can be shifted inwardly against the force of a return spring, as a result of which piston 17 reduces the volume of the media chamber 11. The spring is located within the media chamber 11. Once a corresponding overpressure is attained in the media chamber 11 the piston 17 or its valve part is shifted outwardly with respect to the remaining plunger rod 18, as a result of which the valve 15 is opened. When the pressure drops, a valve spring made in one part with piston 17 recloses the valve 15, the closing faces of which then come into contact with each other. Once the actuating force on the actuating head is released, the unit 5, 16 is returned to its rest position by the return spring. In this position, the travel of the unit 5, 6 is stopped or limited with respect to piston 17 and the inner circumference of the shell 7. This annular space is sealed off from all paths for the medium by the piston 17 and communicates at the outer end of unit 4 with the outside environment via a gap bounded by units 4, 5. Thereby, space 19 is vented but is permanently sealed off from the reservoir chamber and the media paths 11 to 13. In the rest position of the unit 2, the venting path for the space 19 may be closed pressure-tight with respect to the space 19 by a valve.

Between units 2, 3 a filter unit 20 is clamped in place which may consist of one part or several parts. In accordance with FIG. 1 it has three parts or three layers and as shown in FIG. 2 it has two layers. The plate or flat, ring-shaped unit 20 comprises as its thickest layer a flat, ring-shaped filter element 21. On each of the two plate faces of filter element 21, a thinner seal 22, 23 is supported as a substantially full surface cover. The remote faces of these outermost layers 22, 23 provide counter faces 24, 25 in contact with holding faces 26, 27 of unit 4. The holding face 26 is formed by the flat outermost end face of a reservoir neck 28, this end face surrounding the reservoir opening at right angles to axis 10. The holding face 27 is formed by the outermost end face of flange 9. Face 27 opposes holding face 26 and is parallel to face 26. All holding faces, counter faces and layers of unit 20 are annular about axis 10. The inner widths of faces 26, 27 are roughly the same. The outer width of the face 26 is greater than the outer width of face 27. The layers 21 to 22 protrude radially inwards beyond the inner width of the face 26, 27 up to the outer circumference of the shell 7 so that they are centered and guided on the shell 7. The layers 21 to 23 also protrude beyond the outer circumference of the face 27 or of the flange 9, but not as far as the outer circumference of the face 26 or of the neck flange. The shell of the fastener member 6 engages this outer circumference, thus being centered with zero radial clearance. All layers 21 to 23 are commonly axially tensioned between the faces 26, 27 with sealing pressure. Thereby, reservoir chamber 35 is closed and pressure-tight against exit of medium through the filter path.

Between surfaces 26, 27 and between layers 22, 23, gas is able to flow through the layer 21 toward reservoir chamber 35. The outer circumferential edge face as well as outer marginal zones of the two plate faces of the layer 21 form thereby the filter inlet 31 from which the fluid flows between the plate faces and layers radially inwards, i.e. uninterruptedly via the entire annular circumference. The inner circumferential edge face of the layers 21 to 23 may be tensioned against the outer circumference of shell 7 to be squeezed by axial tension. The plate face of the layer 21 facing the face 26 or the chamber 35 is partly freely exposed, it thus forming the filter outlet 32 connecting to the inner circumferential face and oriented axially into chamber 35. It is only through this filter outlet that air is able to flow into the chamber 35. To form the outlet 32 the otherwise sealingly closed layer 22 may have ports. These ports may be formed by a toothed profile configuration of the inner circumference of layer 22 so that the tips of the teeth adjoin the shell 7. Through the gaps between the teeth the air is able to enter an annular space 34 between the shell 7 and the neck 28. Otherwise, no air is able to emerge at the plate faces of the layer 21. Each layer 21 to 23 has a thickness which is constant over its full extent in the released state.

The inlet 31 or the outer circumferential region of the sealing and filter unit 20 is outwardly totally encapsulated within a chamber 29, which is bounded by the face 26, the outer circumference of the flange 9 and by the inside of the thin-walled or sheet metal fastener member 6. The unit 20 is spaced entirely from the inner circumference as well as from the inside of the end wall of the member 6, the inlet 31 also having such a spacing from face 26. The annular filter chamber 29 is connected via openings 33 directly and permanently to the outside air. These venting openings 33 may be ports in the end wall of member 6. The ports are located between the outer circumference of the flange 9 and the shell of the member 6 so that the chamber 29 is always supplied with fresh air. The end wall of member 6 engages with a centering effect both the end face of flange 9 facing away from the face 27 and the outer circumference of the components 7, 8. The openings 33 are spaced from the layer 21.

For assembly the layers 21 to 23 may be mounted individually or as a unit onto the shell 7 from the inner end until they adjoin the face 27 axially and the shell 7 radially substantially without motion play or by clamping. Member 7 is also preassembled with the unit 4. The unit 4 is then introduced through the reservoir opening into the reservoir 3 until the faces 24, 26 come into contact with each other and until the shell of the member 6 clasps the reservoir neck 28 so that the units 2, 3 are precisely centered with respect to each other. They are then tensioned with respect to each other while pressure loading the filter unit 20. Thereby, the shell rim of crimp ring 6 is crimped radially inwards under the annular shoulder of the reservoir neck 28 so that the axial tension is maintained permanently. On the first actuating stroke of the pump 2, the media chamber 11 is vented through valve 15 and duct 13. Then, it is filled with medium from the chamber 35 on the return stroke. Thereby, valve 15 is closed and valve 14 is opened. Due to the dispensing of medium and air, a vacuum results in chamber 35. With the valve 15 closed, this vacuum also maintains the valve 14 closed. However, the vacuum is relieved by the air subsequently drawn into the chamber 35 through the unit 20. The dispenser operates in the same way for every further discharge stroke.

The valve 36 for closing the venting paths of space 19 comprises two valve parts. These are lifted off from each other on commencement of the actuating stroke for opening the valve. The one valve part is formed by an outer annular shoulder of the piston 17 and the other valve part by an annular edge at an inner circumference of the closing part 8 through which the plunger rod 18 passes. In the closed position the closing faces of the valve 36 abut against each other due to the action of the return spring, which returns the unit 5 to the starting or rest position. In all other positions the valve 36 is opened. The space 19 is continually sealed off by the piston lip with respect to the media chamber 11, with no air being able to enter either chamber 34, 35 through the shell 7.

In accordance with FIG. 2 a valve 30 is arranged in the venting path of the filter unit 20. This valve opens when a vacuum exists in chamber 34, 35 and will always reclose as soon as pressure is compensated. The movable valve element 37 covers the outlet 32 in the closed position and renders it free in the open position. The plate or flat, ring-shaped valve part 37 is movable into the reservoir opening and the annular space 34 by being resiliently deflected. In the closing position it covers the associated plate face of layer 21. Its non-movable base may be tensioned between faces 26, 27 and may directly adjoin the layer 21 as well as face 26. Furthermore, the valve 30 may belong to the preassembled units 2, 20. More particularly, the valve part 27 may be made in one part with layer 22*a* and formed by the radial inner annular rim of layer 22*a*. In the closed position the inner circumference of the valve part 37 is expediently in contact with the outer circumference of the shell 7 with a total circumferential seal, whereas in the open position it releases over the full extent of the circumference an annular gap adjoining the shell 7.

In accordance with FIG. 2 one of the counter faces, namely the counter face 25*a* is directly formed by layer 21. Between the faces 25*a*, 27 no separate seal is provided, the seal of this gap being formed directly by the cited faces as a result of which the proportion of the inlet 31 formed by the end side of layer 21 is substantially greater. This proportion adjoins the outer circumference of flange 9 and spacingly directly opposes opening 33. The outer circumference of disk 22*a* can thus extend up to the outer circumference of layer 21. The smallest inner circumference of all layers 21 to 23 or 21, 22*a* may be the same in width.

The pump 2 is fixed to the reservoir vessel 3 with a seal interposed and containing a filter unit 20*a* as a result of which the reservoir chamber 35 can be replenished with filtered outside air in the course of being emptied. This air is unable to flow through the interior of the pump 2. In addition, the filter 21 may be correspondingly selected to meet specifications which are met only after assembly of the pump and the reservoir 35. Furthermore, assembly is facilitated and no separate mount is needed for the filter element 21. All properties and effects may be provided precisely as described or merely approximately or substantially as described.

The radial outer edge of filter element 21 can also be located radially inside the corresponding outer edges of the sealing members 21, 22, 22*a* with respect to the face 27 and with respect to the flange 9. Filter element 21 can furthermore be thinner than each of seal members 21, 22, 22*a*. In axial view the single passage 32 is of pointed V-shape including a V-height of less than 1 millimeter and a flank angle of less than 90° respective 70°, whereby the passage 32 is located in an axial plane of axis 10.

We claim:

1. A dispenser for dispensing media during a discharge operation comprising:

dispenser unit (2) including a thrust operated valve (14, 15) traversed by the media during the discharge operation, and a venting filter (21) for venting a reservoir chamber (35) supplying said dispenser unit (2) with the media, wherein means are provided for assemblingly connecting said dispenser unit (2) with the reservoir chamber (35) and for subsequently tensioning said venting filter (21).

2. The dispenser according to claim 1, wherein said connecting means include tensioning means for commonly tensioning said dispenser unit (2) against a reservoir unit (3) bounding the reservoir chamber (35) with an assembly tension and for simultaneously tensioning said venting filter (21).

3. A dispenser for dispensing media during a discharge operation comprising:

a dispenser unit (2) as a preassembled unit mountable in a vicinity of a container opening on a reservoir unit (3) including a reservoir chamber (35) for the media, said dispenser unit (2) including a dispenser base (4) defining an outermost base outside face; media ducts (11 to 13) located within said outermost base outside face and including a media inlet (12), a media outlet separate from said media inlet and a media chamber (11), said dispenser unit (2) including a closure for closing the reservoir chamber (35) during discharging the media out of said media outlet by being tensioned against the reservoir unit (3) with an assembly tension;

venting means for venting the reservoir chamber (35) with environmental air while said media inlet (12) communicates with the reservoir chamber (35), said venting means including a filter unit (20) including a filter (21) for filtering the environmental air; and holding means for positionally securing said filter (21) with respect to said dispenser (1), wherein said filter unit (20) includes a counter face (24, 25; 25*a*) separate from said dispenser unit (2) for supportingly contacting a holding face (26, 27) of said dispenser (1), and wherein said holding means include means for directly supporting said counter face (24) on the reservoir unit (3) independent from said dispenser unit (2) and for tensioning both said counter face (24) and said filter (21).

4. The dispenser according to claim 3 and further including an annular container end face surrounding the container opening externally as the holding face (26), wherein said filter unit (20) includes a radially inner edge face, a radially outer edge face and first and second end faces including said counterfaces (24, 25; 25*a*), said supporting means being provided for directly contacting said first end face (24) with the container end face (26).

5. The dispenser according to claim 3, wherein said filter unit (20) is a circumferentially uninterrupted annular disk.

6. The dispenser according to claim 3, wherein said dispenser unit (2) includes a housing directly bounding said media chamber (11) with a housing inside face of a housing wall (7), on said housing wall (7) said outermost base outside face including a housing outside face, said filter unit (20) extending substantially entirely outside said housing outside face, means being provided for axially assembling said filter unit (20) with said dispenser unit (2) by a plug-in connection, when assembled with the reservoir unit (3) said housing outside face directly opposing said filter (21).

7. The dispenser according to claim 3 and further including sealing means for sealingly closing the container opening, wherein said sealing means substantially directly connect to said filter unit (20).

8. The dispenser according to claim 3, wherein said filter unit (20) includes sealing means for sealingly closing the reservoir chamber (35) and for permitting venting of the reservoir chamber (35).

9. The dispenser according to claim 3, wherein said filter unit (20) is a multilayer component including a gas-impermeable layer (22, 23) operationally not filtering.

10. The dispenser according to claim 9, wherein said gas-impermeable layer (22, 23) includes said counter face (24, 25).

11. The dispenser according to claim 3, wherein said filter unit (20) includes a filter element (21) located between two sealing elements (22, 23), said filter element (21) being gas-permeable and said two sealing elements being gas-impermeable.

12. The dispenser according to claim 3, wherein said filter unit (20) defines a filter axis (10) and a median filter plane, means being provided for operationally radially traversing the filter unit with a venting flow substantially parallel to said filter plane, opposing plate faces being provided for bounding the venting flow, said plate faces being gas-impermeable and oriented substantially parallel to said filter plane.

13. The dispenser according to claim 3, wherein said filter unit (20) includes a venting duct including a first duct section in which said filter is disposed and a second duct section communicating with said first duct section, said first duct section being oriented in a first flow direction and said second duct section being oriented in a second flow direction oriented transverse to said first flow direction, said second duct section including a venting outlet (32) directly issuing into the reservoir chamber (35), said first duct section being multiply longer than said second duct section.

14. The dispenser according to claim 3, wherein said venting means include a venting duct externally connecting to said filter unit and traversing said filter unit (20), constricting means (30) being provided for constricting and widening said venting duct said constricting means (30) bypassing said media ducts (11 to 13).

15. The dispenser according to claim 14, wherein said constricting means are continuously variable and pressure controlled by a fluid pressure present inside the reservoir chamber (35).

16. The dispenser according to claim 3, wherein said filter unit (20) is an assembly unit separate from said dispenser unit (2) and includes a venting valve (30) variable from an open state to a closed state and back to said open state.

17. The dispenser according to claim 3, and further including a filter chamber (29) substantially entirely receiving said filter unit (20), wherein said filter unit (20) is located both radially and axially substantially external of the container opening and the reservoir unit (3) but inside said filter chamber (29).

18. The dispenser according to claim 3 and further including a fastening member (6) for positionally securing said dispenser unit (2) on the reservoir unit (3) with said assembly tension, said fastening member (6) circumferentially directly enveloping said filter unit (20), said fastening member (6) permitting flow of the environmental air from outside said dispenser (1) into said filter unit (20), said assembly tension tensioning said filter (21).

19. The dispenser according to claim 3, wherein said venting means include a venting duct leading from outside of said dispenser (1) through said filter unit (20) into reservoir chamber (35), said venting duct being substantially entirely separated from said media ducts (11 to 13), on said dispenser unit (2) said outermost base outside face including most external unit faces directly bounding said venting duct from upstream to downstream of said filter unit (20).

20. The dispenser according to claim 3 and further including an annular flange face (27) for rigidly supporting said dispenser unit (2) against the holding face (26) of the reservoir unit (3), said filter unit (20) being axially press-tensioned between said flange face (27) and the holding face (26) with said assembly tension.

21. The dispenser according to claim 3, wherein said dispenser unit (2) includes a thrust piston pump operable from an initial state to a thrust end state and back to said initial state, when in said initial state said media ducts (11 to 13) being sealingly closed, said venting means entirely bypassing said media ducts (11 to 13).

22. The dispenser according to claim 3, wherein said filter unit (20) includes a diaphragm filter (21), said filter unit (20) being semi-permeable.

23. The dispenser according to claim 3, wherein said filter unit (20) includes a filter element (21) made from a sintered material.

24. The dispenser according to claim 3, wherein said holding means and said dispenser unit (2) commonly include a clamping member (9), for clampingly fixing said filter unit (20) between the reservoir unit (3) and said clamping member (9).

25. The dispenser according to claim 3, wherein means are provided for assembling and rigidly fixing said filter unit (20) commonly with said dispenser unit (2) on the reservoir unit (3) and at the container opening internally receiving said dispenser unit (2).

26. The dispenser according to claim 3, wherein the reservoir chamber (35) and the container opening are bounded around an axis (10) by a neck wall (28) including an end face for receiving an assembly pressure of said assembly tension, assembling means being included which permit direct support of said filter unit (20) on the neck wall prior to separately assembling said dispenser unit (2) on the neck wall, when seen parallel to said axis (10) and when said filter (21) is assembled with the neck wall said filter (21) covering the neck wall.

* * * * *

UNITED STATES PATENT AND TRADEMARK OFFICE

CERTIFICATE OF CORRECTION

PATENT NO. : 5,927,559

DATED : July 27, 1999

INVENTOR(S) : Bommer et al.

It is certified that error appears in the above-identified patent and that said Letters Patent is hereby corrected as shown below:

In column 7, line 27, "dispenser" should be --a dispenser--.

Signed and Sealed this

Twenty-ninth Day of February, 2000

*Attest:*

Q. TODD DICKINSON

*Attesting Officer*

*Commissioner of Patents and Trademarks*